US009307789B2

(12) United States Patent
Griesmayr et al.

(10) Patent No.: US 9,307,789 B2
(45) **Date of Patent: *Apr. 12, 2016**

(54) MOUTHPIECE LINING PAPER FOR A SMOKING ARTICLE

(71) Applicant: TANNPAPIER GMBH, Traun (AT)

(72) Inventors: Guenther Griesmayr, Wels (AT); Barbara Puehringer, Oftering (AT); Marco Scheuchl, Traun (AT)

(73) Assignee: TANNPAPIER GMBH, Traun (AT)

( * ) Notice: Subject to any disclaimer, the term of this patent is extended or adjusted under 35 U.S.C. 154(b) by 0 days.

This patent is subject to a terminal disclaimer.

(21) Appl. No.: 14/362,042

(22) PCT Filed: Nov. 30, 2012

(86) PCT No.: PCT/AT2012/050187

§ 371 (c)(1),
(2) Date: May 30, 2014

(87) PCT Pub. No.: WO2013/078494

PCT Pub. Date: Jun. 6, 2013

(65) Prior Publication Data

US 2014/0326261 A1 Nov. 6, 2014

(30) Foreign Application Priority Data

Dec. 1, 2011 (AT) ..... A 1783/2011

(51) Int. Cl.
*A24D 1/02* (2006.01)
*A24D 1/04* (2006.01)
(Continued)

(52) U.S. Cl.
CPC . *A24D 1/02* (2013.01); *A24C 5/007* (2013.01); *A24C 5/565* (2013.01); *A24D 1/025* (2013.01); *A24D 1/027* (2013.01); *A24D 1/042* (2013.01); *A24D 1/045* (2013.01)

(58) Field of Classification Search
USPC ..... 427/179, 197, 282, 288, 444; 162/131; 131/336, 361, 365
See application file for complete search history.

(56) References Cited

U.S. PATENT DOCUMENTS 2,755,206 A 7/1956 Statia
3,460,959 A * 8/1969 Neuhaus ..... 428/143
(Continued)

FOREIGN PATENT DOCUMENTS

AT 260756 3/1968
CN 2193654 4/1995
(Continued)

OTHER PUBLICATIONS

Definition of "lacquer", The Free Dictionary by Farlex, [online], No Date, retrieved from the Internet, [retrieved May-Aug. 2015], <URL: http://www.thefreedictionary.com/lacquer>.*
(Continued)

*Primary Examiner* — Dennis Cordray
(74) *Attorney, Agent, or Firm* — Brooks Kushman P.C.

(57) ABSTRACT

A mouthpiece lining paper for a smoking article, which mouthpiece lining paper forms the outermost layer of the casing of the filter. The mouthpiece lining paper is provided with locally limited raised areas that are formed by hardened lacquer. Between the raised areas, surface regions of the mouthpiece lining paper are provided, above which the raised areas protrude by at least 5 μm in the direction perpendicular to the plane of the mouthpiece lining paper.

24 Claims, 3 Drawing Sheets

(51) Int. Cl.
*A24C 5/00* (2006.01)
*A24C 5/56* (2006.01)

(56) References Cited

U.S. PATENT DOCUMENTS

| | | | | | |
|---|---|---|---|---|---|
| 3,916,914 | A | | 11/1975 | Brooks et al. | |
| 4,121,595 | A | * | 10/1978 | Heitmann et al. | 131/281 |
| 4,185,643 | A | | 1/1980 | Riedesser | |
| 4,286,605 | A | * | 9/1981 | Goslin et al. | 131/358 |
| 4,295,478 | A | * | 10/1981 | Yeatts | A24C 5/472 131/336 |
| 4,361,156 | A | | 11/1982 | Hall | |
| 4,411,279 | A | * | 10/1983 | Martin | A24C 5/472 131/90 |
| 4,434,805 | A | * | 3/1984 | Hall | A24C 5/472 131/358 |
| 4,583,558 | A | | 4/1986 | Luke | |
| 4,614,199 | A | * | 9/1986 | Berger | A24D 3/043 131/336 |
| 4,643,205 | A | | 2/1987 | Redding et al. | |
| 4,675,064 | A | | 6/1987 | Berger | |
| 4,869,275 | A | | 9/1989 | Berger | |
| 2003/0178039 | A1 | | 9/2003 | White et al. | |
| 2008/0029111 | A1 | | 2/2008 | Dube et al. | |
| 2008/0156336 | A1 | * | 7/2008 | Wyss-Peters et al. | 131/274 |
| 2010/0108084 | A1 | | 5/2010 | Norman et al. | |
| 2011/0155000 | A1 | | 6/2011 | Kaljura et al. | |
| 2012/0240948 | A1 | | 9/2012 | Griesmayr | |
| 2013/0093117 | A1 | | 4/2013 | Griesmayr | |
| 2013/0139837 | A1 | | 6/2013 | Kaljura et al. | |

FOREIGN PATENT DOCUMENTS

| | | |
|---|---|---|
| CN | 201365521 | 12/2009 |
| CN | 201365522 | 12/2009 |
| DE | 630817 | 6/1936 |
| DE | 1928432 | 12/1965 |
| DE | 1532252 | 2/1970 |
| DE | 2327822 | 12/1974 |
| DE | 2743986 | 4/1979 |
| DE | 2927893 | 10/1984 |
| DE | 3005793 | 5/1985 |
| DE | 3411511 | 6/1995 |
| DE | 102005025758 | 12/2006 |
| EP | 0539009 | 4/1993 |
| EP | 0838166 | 4/1998 |
| EP | 1044615 | 10/2000 |
| EP | 1891866 | 2/2008 |
| EP | 1942753 | 5/2009 |
| EP | 1895863 | 12/2009 |
| GB | 269194 | 12/1927 |
| GB | 294492 | 5/1929 |
| GB | 334271 | 9/1930 |
| GB | 337501 | 11/1930 |
| GB | 433228 | 8/1935 |
| GB | 1422286 | 1/1976 |
| GB | 2135912 | 9/1984 |
| GB | 2199726 | 7/1988 |
| WO | 2006128551 | 12/2006 |
| WO | 2007052170 | 5/2007 |
| WO | 2008019281 | 2/2008 |
| WO | 2009027331 | 3/2009 |
| WO | 2010051076 | 5/2010 |
| WO | 2011001200 | 1/2011 |
| WO | 2011038430 | 4/2011 |
| WO | 2011042353 | 4/2011 |
| WO | 2011060459 | 5/2011 |
| WO | 2013046327 | 4/2013 |

OTHER PUBLICATIONS

International Search Report for PCT/AT2012/050187, English translation attached to original, Both completed by the European Patent Office on May 24, 2013, All together 7 Pages.

* cited by examiner

MOUTHPIECE LINING PAPER FOR A SMOKING ARTICLE

CROSS-REFERENCE TO RELATED APPLICATION

This application is the U.S. national phase of PCT Application No. PCT/AT2012/050187 filed on Nov. 30, 2012, which claims priority to Austrian Patent Application No. A 1783/2011 filed on Dec. 1, 2011, the disclosures of which are incorporated in their entirety by reference herein.

The invention relates to a mouthpiece lining paper for a smoking article.

Five important parts of a conventional filter cigarette are the tobacco rod, the cigarette paper encasing the latter, the filter, the filter casing paper and the mouthpiece lining paper.

The mouthpiece lining paper, often also designated "tipping paper" or "tipping" for short, encases the filter and the filter casing paper. It is that part of the filter cigarette which, during the smoking of the filter cigarette, is touched by the lips of the person smoking the cigarette. The mouthpiece lining paper usually also projects slightly in the longitudinal direction of the filter cigarette into the longitudinal region of the tobacco rod, encases the cigarette paper there and is connected to the latter by an adhesive bond. As a result of the production of this adhesive bond, filter part and tobacco rod part are connected mechanically in the cigarette making machine. The mouthpiece lining paper is mostly actually a paper but it can also be a film or a foil. In the event that the mouthpiece lining paper is formed as a film or foil, it can consist of cellulose hydrate, for example.

At the end close to the tobacco rod, the mouthpiece lining paper is normally designed to be somewhat perforated so that, when sucking on the cigarette, air from the surroundings passes into the filter and is mixed there with the stream of smoke coming from the tobacco rod, by which means the smoking values are advantageously changed.

Usually, the mouthpiece lining paper has a visually attractive print. This print is often reminiscent of cork or tobacco. Use is also made of mouthpiece lining papers which, in addition to the visual print, have a covering of substances or an impregnation with substances which, during smoking, cause one or more sensations such as smell, taste, cold (freshness) or heat (sharpness). For example, in WO2006128551 A1, it is proposed to apply an aromatic substance with the aid of an inkjet printer, for example, to the mouthpiece lining paper.

In DE 3411511 C2, it is proposed to equip the mouthpiece lining paper with a substance which permanently changes its color as a result of elevated temperature. In order to bring about the color change, the mouthpiece lining paper is embossed with a heated stamp having a surface structure, in order that a structure is also embossed onto the mouthpiece lining paper.

Between the mouthpiece lining paper and the actual filter there is normally located the filter casing paper, the main function of which is to fix the material or the material components of the filter intrinsically mechanically, at least until everything is in any case held together by the mouthpiece lining paper, which is only applied in the cigarette making machine. In DE 3005793 C2 it is proposed to form the filter casing paper, which in the finished cigarette ultimately represents an intermediate layer, from a very highly porous paper for air permeability reasons, and to print said paper with a very fine grid of textured varnish. The textured varnish improves the otherwise disturbingly low mechanical stability of the highly porous paper. Because the textured varnish is applied only as a fine grid, it does not reduce the desired high air permeability. In DE 3005793 C2, a hot-melt plastic adhesive is proposed as a suitable textured varnish.

A textured varnish in the sense of this description is a varnish with which a fine grid of a palpable elevated structure can be printed on a surface; for example for this purpose 5 to 30 lines lying beside one another can be printed per centimeter, projecting upward from non-printed surface areas by 10 μm to 30 μm. However, it is also possible to print finer structures, for example with 100 lines lying beside one another per centimeter.

Using textured varnish, palpable prints can be produced; applications for this purpose are the printing of Braille, the improvement of the detectability of monetary notes and the improvement of the haptic impression of packaging. The latter is proposed, for example, in WO 2011/001200 A1.

A further important area of application of textured varnishes relates to changing the frictional properties of a surface; depending on the objective, by choosing the suitable varnishing material, either the ability to slide or the coefficient of friction can be increased.

In DE 2927893 C2, it is proposed to print the cigarette paper with a structure with the aid of a textured varnish which contains tobacco powder, so that it is as similar as possible in look and feel to a leaf of tobacco.

Admittedly there already exist many possible ways of configuring mouthpiece lining papers optically and also equipping the same with means for senses other than visual ones. However there are strict restrictions in choosing substances and states of substances which can be applied for this purpose. One important restriction results from the fact that the mouthpiece lining paper is subjected to considerable frictional and compressive loadings during the fabrication and packaging of filter cigarettes. Other restrictions result from environmental influences, such as in particular high atmospheric humidity, which are able to influence functional substances detrimentally in the finished product.

The primary object of the present invention is to reduce the restrictions mentioned in the previous paragraph and thus to expand the possible choices of substances and states of substances which can be used for the purpose of influencing the properties of mouthpiece lining paper.

In order to achieve the object, it is proposed to provide the mouthpiece lining paper with elevated surface areas by means of locally limited printing with textured varnish. In an advantageous further development, further substances are applied to the non-elevated regions of the mouthpiece lining paper, not being applied so heavily, if at all, to the mouthpiece lining paper as the textured varnish.

In the finished state, the surface of the mouthpiece lining paper thus constitutes a landscape which has planes and mountains projecting upward from the latter, wherein substances such as for example colorants or perfumes are applied to the planes and wherein the mountains, projecting beyond these planes, consist of hardened textured varnish.

The most important function of the elevations formed by textured varnish is that of the protection of the substances applied to the surface areas located lower down. This protective function is achieved in that hard elements which strike the mouthpiece lining paper or slide or rub on the latter come into contact predominantly or exclusively only with the tips of the elevations of textured varnish and not with the surface areas located in between. As a result, in the surface areas located in between, even substances that are sensitive to touch can be kept for a long time in the undamaged state.

The invention will be explained in more detail by using drawings.

Figure 1:
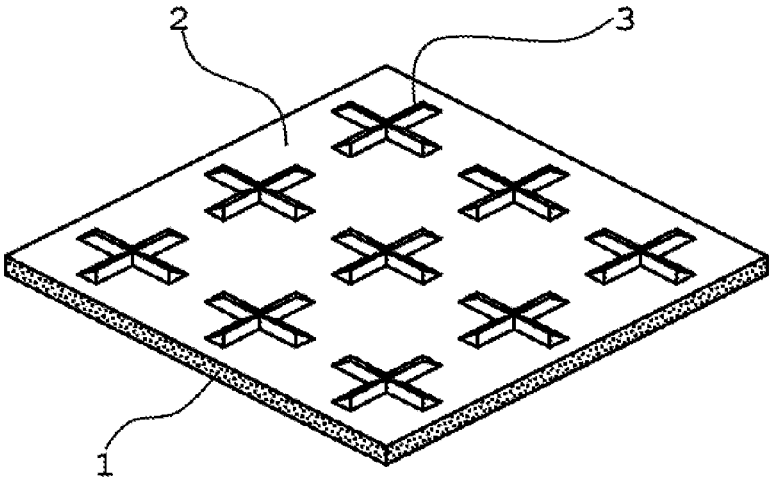
FIG. 1 shows, in a stylized perspective illustration, a section of a first mouthpiece lining paper according to the invention.
Figure 2:
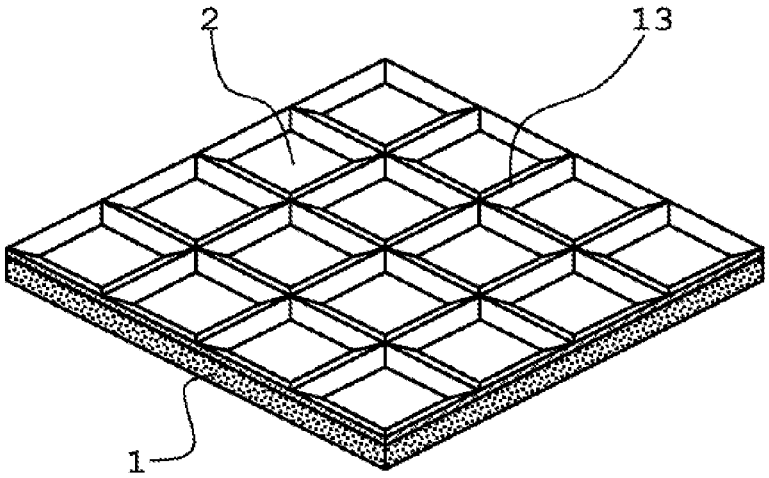
FIG. 2 shows, in a stylized perspective illustration, a section of a second mouthpiece lining paper according to the invention.

According to FIG. 1 and FIG. 2, one side of the mouthpiece lining paper 1 is provided with elevations 3, 13 by applying textured varnish.

For reasons of clarity, the illustrations according to FIG. 1 and FIG. 2 do not depict reality to scale. The height of the elevations 3, 13 formed from textured varnish is illustrated disproportionately highly extended. Otherwise than is actually the case in reality, the partial surfaces of the surface of the elevations 3, 13 formed from textured varnish are drawn exclusively as flat surfaces which adjoin neighboring surfaces without any rounding.

In the example according to FIG. 1, a grid of island-like elevations spaced apart from one another and having a cross-shaped outline is formed by textured varnish. The area 2 not covered with textured varnish is not divided into individual partial areas separated from one another.

In the example according to FIG. 2, the elevations 13 consisting of textured varnish form a grid of intersecting lines which are continuous over several grid periods, between which rectangular areas 2 to which no textured varnish is applied are enclosed.

As a result of the elevations formed from textured varnish, the surface areas 2 lying lower down are protected against being touched by blunt objects, since these objects strike the meshes of the elevations 3, 13. The elevations 3, 13 therefore act as spacers.

Because of this spacer function, it is possible to use for the surface areas 2 lying lower down in a protected manner coatings which hitherto could not be used for this purpose on account of their too high a sensitivity with respect to mechanical damage or generally with respect to contact. For example, this means:

- It is now possible even to apply to the areas 2 varnishes which have relatively large colored pigments projecting out of the polymer matrix of the varnish. Hitherto, the use of such varnishes—with which very advantageous visual effects can be achieved—was barely possible, since the projecting pigments were rubbed off by friction of the mouthpiece lining paper 1 on itself and on machine parts during the production and packaging of the cigarettes.
- In general, it is now possible even for porous, readily fragile layers sensitive to abrasion to be applied to the areas 2 or for the area 2 to be impregnated therewith.
- The areas 2 can be provided with substances from which, in the course of a drying process, small crystals grow on the surface. These crystals can appear visually advantageous and they can taste good. For example, the crystals can consist primarily of salt or sugar.
- For the first time, a multiplicity of coatings and impregnations which consist of a hardened matrix and substances with a sensory action enclosed therein in encapsulated form can be used for the areas 2, wherein the encapsulated substances with a sensory action are liberated only by ambient conditions that occur. Hitherto, layers in which substances with a sensory action were contained in encapsulated form were mechanically too sensitive for this application.
- Note: in this document, the term "substance with a sensory action" designates in summary form substances such as flavors (perceptible by means of the sense of taste), fragrances (perceptible by means of the sense of smell), substances that can be perceived as cold (freshness) or heat or other stimulus, or else substances which modify, for example neutralize or absorb, the sensation of odorous substances.
- The areas 2 can now also be provided with substances which—in addition to other desired functions—can also remain or become pasty or gel-like and which therefore, in the event of direct contact, can feel sticky or greasy. Hitherto, substances of this type could not be used, since cigarettes would then be stuck to one another. In particular, coating or impregnating substances (such as sugar or citric acid, for example), which become sticky when kept for a relatively long time in high atmospheric humidity, can for the first time also be applied without difficulty.
- It is also possible for powder, that is to say small particles such as flakes, spice crystals, plant dusts, etc., to be applied to the area 2, wherein a multiplicity of these particles are present jointly as powder or dust or the like and are not surrounded by a liquid, hardenable matrix. Hitherto, this was not practically possible, since the particles would have been rubbed off again before the cigarette had been consumed.
- The particles of the powder can be applied to the surface 2 wholly or largely wholly without the application of binder.
- However, it is of course also possible to print the area 2 firstly with a thin layer of binder and then to apply powder to the not yet hardened binder. Only a small portion of the surface of the particles is then in contact with the binder.
- Therefore, means which, as intended, are transferred to the lips or fingers of the smoking person as a result of contact with the lips or the fingers of said person can be applied to the mouthpiece lining paper. This is primarily of interest for skin-care substances and for substances which help to avoid disruptive smells (e.g. on the fingers).

In addition to the protective function for coatings or impregnations of the surface areas 2 of the mouthpiece lining paper 1 that are located lower down, further advantages can be achieved by the structured elevations 3, 13:

Before the mouthpiece lining paper 1 is finally processed on the cigarette making machine, it is provided with diverse prints and possible impregnations. Between the individual processing steps, the mouthpiece lining paper 1 is present in the form of rolls. It is necessary for solvents which originate from the various prints and impregnations to evaporate from these rolls. As a result of the presence of structured elevations 3, 13, this evaporation takes place more quickly than without these elevations, since, because of their spacer function, said elevations effect a better ventilation of the paper. It is therefore possible to dispense with intermediate storage times. In this connection, an arrangement of local elevations 3 separated from one another in the manner of islands (FIG. 1) is more advantageous than elevations 13 which form a continuous network (FIG. 2).

By means of the structured elevations, which, for this purpose, should preferably be separated from one another in the manner of islands, not only can the evaporation of substances to be removed be accelerated but it is also conversely possible for the contact with the mouthpiece lining paper of desired substances, which are present as gas, vapor, aerosol or powder and/or combinations thereof, to be accelerated while said mouthpiece lining paper is stored as a roll in an environment enriched with the relevant gas phase. As a result of this contact, for example, several substances that can reasonably be handled as a vapor phase and have a sensory action can be introduced very carefully into the mouthpiece lining paper. However, it is also possible for substances which are already in or on the mouthpiece lining paper to be changed deliberately by means of a gentle reaction with the gas phase of a substance surrounding the mouthpiece lining paper, in the sense of "allowing [it] to mature". In order to intensify the contact between mouthpiece lining paper and gas phase, the gas phase can be moved, for example by a blower.

If a structure 3 of elevations is applied to that side of the mouthpiece lining paper 1 which is located facing the filter casing paper in the finished cigarette, the situation is therefore achieved in which air can flow to an increased extent between mouthpiece lining paper 1 and filter casing paper. This is helpful for the adjustment of desired smoking values, which is certainly done to a high extent by fresh air being mixed in the filter with the stream of smoke coming from the tobacco rod. In this connection, too, an arrangement of local elevations 3 separated from one another (FIG. 1) is more advantageous than elevations 13 which form a continuous network (FIG. 2).

By means of structured elevations 3, 13, the haptic sensation when taking hold of a cigarette can be improved. In particular, it can therefore be made easier to remove a cigarette from a full cigarette pack.

Figure 3:
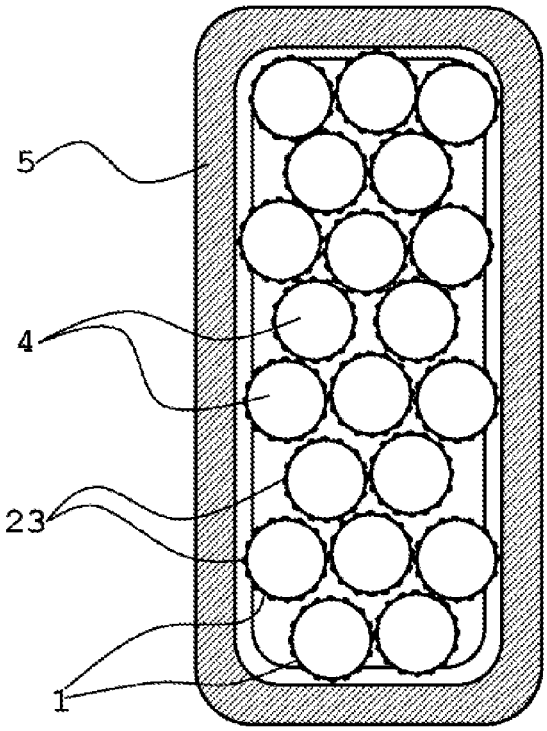
FIG. 3 shows part of a cigarette packaging machine in a partial sectional view. Here, the viewing direction is parallel to the conveying direction of the cigarettes.

FIG. 3 shows that part of a cigarette packaging machine in which a very high frictional demand is placed on the mouthpiece lining paper of a cigarette. For the packing of cigarettes 4 into a cigarette pack, the cigarettes 4 to be introduced into the pack are moved in the longitudinal direction of the same along a narrowing delivery channel 5. In the process, the cigarettes 4 are pressed more and more intensely against one another and rub on the walls of the delivery channel 5. This rubbing takes place primarily with the mouthpiece lining paper 1 of the cigarettes, since the latter encloses the filter part of the cigarettes 4, which is stronger compared with the tobacco rod part. Since, according to the invention, the mouthpiece lining paper 1 is provided on the outer side thereof with a structure of elevations 3, 13, 23 made of hardened textured varnish, the surface areas of the mouthpiece lining paper 1 located between these elevations are protected against friction with the walls of the delivery channel 5. For this application purpose, it is advantageous if the elevations 23 are formed by a varnish material which, when hardened, exhibits a lowest possible coefficient of friction with respect to metal.

At the cigarette making machine, a piece of mouthpiece lining paper is wound around the filter part of the cigarette. The edges of the mouthpiece lining paper, overlapping one another to a small extent in the circumferential direction of the cigarette, are glued to each other. During the gluing operation, a certain minimum adhesion must be achieved very quickly between the overlapping edges of the mouthpiece lining paper, since otherwise the cycle rate of the cigarette making machine will be reduced. The minimum adhesion is achieved in an accelerated manner if the water absorption capacity of the elements to be glued is accelerated and/or if the elements to be glued facilitate the mechanical anchoring by means of parts projecting from the surface. The elevations 3, 13, 23 constitute parts projecting in this way. They preferably contain a substance which absorbs water well. The application of structured elevations 3, 13, as an agent during gluing is then decisively important and advantageous if the mouthpiece lining paper used is not a true paper but a film, for example of cellulose hydrate.

Primarily in the half of the mouthpiece lining paper on the tobacco rod side, said paper is normally designed to be somewhat perforated, so that, when sucking on the cigarette, air from the surroundings passes into the filter and mixes there with the stream of smoke coming from the tobacco rod, by which means the smoking values are advantageously changed. If the mouthpiece lining paper is not a true paper but a film, then experience shows that, as a result of the perforation—which is normally brought about by a laser—a small burr sticking out from the plane of the mouthpiece lining paper is formed at the edge of the individual perforation holes. This burr is then very highly disruptive if, before the processing in the cigarette making machine, the mouthpiece lining paper is intended to be wound up to form a bobbin with many individual wound layers. This is because, in the individual wound layers, the surface areas of a wound layer on which the said burr is located lies precisely on those surface layers of the next inner winding on which said burrs are also located. This ultimately has the effect that, as a result of the winding, very much higher tensile stresses occur in the surface areas of the mouthpiece lining paper in which the perforation holes are located than in surface areas in which there are no perforation holes. The effect increases so highly with the increasing number of windings that, as a result, the maximum possible number of windings is disruptively limited. As a remedy, either only bobbins having a relatively small number of windings are wound or the perforation is produced only in the cigarette making machine, specifically when the mouthpiece lining paper, following perforation, is just no longer wound up to form a bobbin. Both remedies have disadvantages. The first possibility has the effect of an undesired increase in the logistical outlay. In the case of some types and thicknesses of mouthpiece lining papers formed as film, the second possibility has the effect of a disruptive limitation to the maximum speed with which the cigarette making machines can operate.

Since the mouthpiece lining paper formed as a film is formed with a structure of elevations 3, 13, 23 of hardened varnish, those elevations which have been formed by the perforation as a burr around the perforation openings are unimportant when the mouthpiece lining paper is wound up to form a bobbin. The tensile force on the mouthpiece lining paper required during winding is better distributed uniformly over a greater width of the mouthpiece lining paper as a result. As a result, it is possible for bobbins having a higher number of windings to be formed, without any damage occurring to the perforation zones.

The effect is then particularly severe if perforation holes are applied only to those surface areas 2 of the mouthpiece lining paper formed as a film which lie between the elevations 3, 13, 23.

For the protective function mentioned, it is important that the elevations 3, 13, 23 of hardened textured varnish project upward in the direction lying normal to the plane of the mouthpiece lining paper 1, above the surface areas 2 of the mouthpiece lining paper 1 which lie between individual elevations and are not provided with textured varnish. From geometrical considerations, it can be seen directly that the elevations should project to a greater extent if the distance between the same becomes larger and if the surface to which they are applied is curved more convexly. The perceptibility of structured coatings begins at a height of the coating of about 5 to 15 μm.

Suitable as materials of the textured varnish are primarily those types of varnish which are predominantly applied to the surfaces contacted thereby and to a lesser extent those which are predominantly absorbed. Many textured varnishes are known in specialist circles.

Suitable methods for the application of textured varnish to the mouthpiece lining paper are primarily screen printing, in particular rotary screen printing, and also gravure printing, in particular web-fed rotary gravure printing. Rotary screen printing and web-fed rotary gravure printing are well suited to paper tapes. The fastest printing for the present application is possible by means of web-fed rotary gravure printing.

In the case of gravure printing, a printing form, the surface of which has depressions, is wetted with varnish, then wiped off by means of a doctor and then brought into contact with the surface to be printed, part of the varnish remaining in the depressions remaining adhering to the surface to be printed. In the case of web-fed rotary gravure printing, the printing form is a roll, what is known as the press roll. This rotates about a horizontal axis and is arranged in such a way that the lower circumferential surface area thereof travels through a bath of varnish and the upper circumferential surface area thereof touches the paper to be printed, which is moved at the circumferential speed of the press roll. The circumferential surface of the press roll has depressions. The circumferential surface of the press roll is wetted with varnish in the bath of varnish. Excess varnish lifted out of the bath of varnish is wiped off the surface of the press roll by means of a doctor; part of the remaining varnish arranged in the depressions is transferred to the paper upon contact with the paper to be printed. The aforesaid depressions on the circumferential surface of the press roll are approximately 30 μm to 50 μm deep in the case of the conventional printing of mouthpiece lining paper. For the printing of mouthpiece lining paper for producing a varnish structure according to the invention, the depressions must be at least about 20 μm deep (if the surface areas 2 are not printed by means of applying pressure and if the printed structures are relatively fine) and can be a maximum of about 240 μm deep. Very good results are achieved if the depth is between 100 μm and 150 μm.

It should further be pointed out that the printed structures do not need to extend in a uniform density over the entire surface of one side of the mouthpiece lining paper. For instance, more and/or differently shaped elevations can be applied to those surface areas which are primarily touched by the fingers of the smoking person than to those surface areas which are primarily touched by the lips of the smoking person.

In addition, the surface areas 2 of the mouthpiece lining paper which are not elevated can be treated differently in different regions of the mouthpiece lining paper. For example, substances which help to avoid disruptive smell on the fingers can primarily be applied to that part of the mouthpiece lining paper which is located closer to the tobacco rod in the finished cigarette and will therefore primarily be touched by the fingers of the person smoking the cigarette. Toward the open end of the filter part of the cigarette, the surface areas 2 of the mouthpiece lining paper should rather be provided with flavorings or with a lip care substance.

The invention claimed is:

1. A mouthpiece lining paper for a cigarette, which forms the outermost layer of the casing of the filter, comprising a structure of locally limited elevations made of hardened varnish, said elevations project by at least 5 μm in the direction normal to a plane of surface areas of the mouthpiece lining paper that are located between said elevations;

wherein the elevations are arranged on the outer side of the mouthpiece lining paper, and said surface areas that are located between said elevations are provided with substances, said elevations project further from the plane of the mouthpiece lining paper than said substances.

2. The mouthpiece lining paper as claimed in claim 1, wherein a varnish which has colored pigments projecting out of the polymer matrix of the varnish is applied to said surface areas that are located between said elevations.

3. The mouthpiece lining paper as claimed in claim 1, wherein a substance having a sensory action is applied to said surface areas that are located between said elevations.

4. The mouthpiece lining paper as claimed in claim 3, wherein a substance, the surface of which has crystals, is applied to said surface areas that are located between said elevations.

5. The mouthpiece lining paper as claimed in claim 3, wherein a substance which has a matrix and substances with a sensory action enclosed therein in encapsulated form is applied to said surface areas that are located between said elevations.

6. The mouthpiece lining paper as claimed in claim 3, wherein a substance which is pasty, gel-like, sticky and/or greasy is applied to said surface areas that are located between said elevations.

7. The mouthpiece lining paper as claimed in claim 3, wherein particles without a surrounding hardened liquid matrix are applied to said surface areas that are located between said elevations.

8. The mouthpiece lining paper as claimed in claim 1, wherein, said surface areas, that are located closer to a first end face of the mouthpiece lining paper to be located adjacent an end of the cigarette are provided with a different substance than those located closer to an opposite end face of the mouthpiece lining paper.

9. The mouthpiece lining paper as claimed in claim 1, wherein the mouthpiece lining paper is a film or foil material.

10. The mouthpiece lining paper as claimed in claim 9, wherein the mouthpiece lining paper consists of cellulose hydrate.

11. The mouthpiece lining paper as claimed in claim 9, wherein the hardened varnish of which said elevations consist is hygroscopic and/or water-absorbent.

12. The mouthpiece lining paper as claimed in claim 9, wherein it has perforation holes.

13. The mouthpiece lining paper as claimed in claim 12, wherein the perforation holes are located exclusively in said surface areas that are located between said elevations.

14. A mouthpiece lining paper for a cigarette, which forms the outermost layer of the casing of the filter, comprising a structure of locally limited elevations made of hardened varnish, said elevations project by at least 5 μm in the direction normal to a plane of surface areas of the mouthpiece lining paper that are located between said elevations;

wherein the elevations consist of a hardened varnish which, with respect to metal and/or ceramic, has a lower coefficient of friction than said surface areas that are located between said elevations or substances that are applied to said surface areas.

15. The mouthpiece lining paper as claimed in claim 14, wherein said elevations are arranged on the inner side of the mouthpiece lining paper.

16. The mouthpiece lining paper as claimed in claim 15, wherein said elevations project upward out of an undivided area in the manner of islands, which means without any connection to one another.

17. A method for the production of a mouthpiece lining paper for a cigarette which forms the outermost layer of the casing of the filter, wherein varnish is applied to the mouthpiece lining paper in a structure of locally limited elevations and surface areas of the mouthpiece lining paper that are located between said elevations are applied with at least one other substance, wherein the mouthpiece lining paper provided with said elevations is treated with a gaseous, vapor-like, aerosol-like or powder-like active material or an active material from the combination thereof, in that it is stored and/or forcibly flooded as a roll in an environment which is enriched with the gaseous, vapor-like, aerosol-like or powder-like active material or an active material from the combinations thereof to apply said active material to the surface areas of the mouthpiece lining paper that are located between said elevations.

18. The method as claimed in claim 17, wherein active material is moved through said roll of mouthpiece lining paper.

19. The method as claimed in claim 17, wherein said elevations project upward normal to said surface areas of the mouthpiece lining paper in the manner of islands, without any connection to one another.

20. The method as claimed in claim 17, wherein said other substance is applied in the form of a powder, that is to say as a multiplicity of particles which are not connected to one another by a liquid matrix, to said surface areas which are located between said elevations.

21. The method as claimed in claim 20, wherein said surface areas are provided with a contact adhesive before the application of the powder.

22. The method as claimed in claim 17, wherein, said mouthpiece lining paper is a film or foil material that is provided with perforation holes and wound up to form a bobbin afterwards.

23. The method as claimed in claim 22, wherein the perforation holes are formed only at a distance from elevations, or varnish which is hardened to form said elevations is applied to the mouthpiece lining paper only at a distance from the perforation holes.

24. A mouthpiece lining paper for a cigarette, which forms the outermost layer of the casing of the filter, comprising, a structure of locally limited elevations made of hardened varnish, said elevations project by at least 5 μm in the direction normal to the plane of surface areas of the mouthpiece lining paper that are located between said elevations, wherein said mouthpiece lining paper is a film or foil material.

* * * * *